US008478152B2

(12) United States Patent
Tomizawa

(10) Patent No.: US 8,478,152 B2
(45) Date of Patent: Jul. 2, 2013

(54) IMAGE FORMING APPARATUS AND METHOD USING DIFFERENT TRANSFER VOLTAGES WHEN RECORDING MATERIAL IS HEATED IN DIFFERENT IMAGE FORMING MODES USING DIFFERENT NUMBERS OF HEATING DEVICE

(75) Inventor: Takeshi Tomizawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 728 days.

(21) Appl. No.: 12/027,527

(22) Filed: Feb. 7, 2008

(65) Prior Publication Data

US 2008/0187375 A1 Aug. 7, 2008

(30) Foreign Application Priority Data

Feb. 7, 2007 (JP) ..... 2007-028594

(51) Int. Cl.
*G03G 15/16* (2006.01)
*G03G 15/20* (2006.01)
*G03G 15/00* (2006.01)

(52) U.S. Cl.
USPC ..... 399/66; 399/341; 399/401

(58) Field of Classification Search
USPC ..... 399/66
See application file for complete search history.

(56) References Cited

U.S. PATENT DOCUMENTS

| | | | | |
|---|---|---|---|---|
| 6,347,200 | B1 * | 2/2002 | Shigeta et al. | 399/66 |
| 7,336,920 | B2 * | 2/2008 | Anderson et al. | 399/341 |
| 2006/0245795 | A1 * | 11/2006 | Kamiyama | 399/322 |
| 2007/0183803 | A1 * | 8/2007 | Bae | 399/66 |

FOREIGN PATENT DOCUMENTS

| | | |
|---|---|---|
| JP | 60-017777 | 1/1985 |
| JP | 2-273771 | 11/1990 |
| JP | 2000-221821 | 8/2000 |
| JP | 2006-308889 | 11/2006 |

* cited by examiner

*Primary Examiner* — David Gray
*Assistant Examiner* — Andrew Do
(74) *Attorney, Agent, or Firm* — Fitzpatrick, Cella, Harper & Scinto

(57) ABSTRACT

An image forming apparatus includes an image bearing member for carrying a toner image, a transferer supplied with a voltage to transfer a toner image from the member onto a recording material in a transfer portion, heaters with different heating conditions for heating the image transferred onto the material, a refeeder for refeeding the material to the transfer portion to transfer the image onto the material having the image fixed by the heater, a selector for selecting the glossiness of the image after fixing, a device for determining the heater to heat the image from the heaters in accordance with the glossiness selected by the selector, and a device for changing the voltage for transferring the image onto the refed material in accordance with the heater having heated the image on the material prior to the material being refed by the refeeder.

4 Claims, 9 Drawing Sheets

IMAGE FORMING APPARATUS AND METHOD USING DIFFERENT TRANSFER VOLTAGES WHEN RECORDING MATERIAL IS HEATED IN DIFFERENT IMAGE FORMING MODES USING DIFFERENT NUMBERS OF HEATING DEVICE

FIELD OF THE INVENTION AND RELATED ART

The present invention relates to an image forming apparatus in which a toner image is fixed by passing a recording material having a transferred toner image through a plurality of heating portions. Particularly, it is related with a control of a transfer voltage in the case that a toner image is retransferred to the recording material which already has the fixed toner image in a back side printing and so on.

In a widely used image forming apparatus, a toner image carried on an image bearing members, such as a photosensitive drum, an intermediary transfer member, and so on, is transferred onto a recording material by a transfer portion which has the transferring means supplied with a transfer voltage, and thereafter, the recording material is passed through a heating portion, by which the toner image is fixed.

JP 2000-221821-A discloses an image forming apparatus which has a plurality of heaters arranged in series with respect to the movement direction of the recording material. Here, in order to change a glossiness of the toner image after a heat-fixing operation, heaters for heating the toner can be used selectively.

However, in the image forming apparatus disclosed in this publication, the recording material passes through the heaters selected in order to provide a desired glossiness so that an electric resistance of the recording material after the fixing changes from that before the fixing. For this reason, when the toner image is transferred after the recording material is resupplied to the transfer portion, a transfer voltage applied to the transferring means is sometimes improper.

SUMMARY OF THE INVENTION

The object of the present invention is to provide an image forming apparatus which can satisfactorily transfer a toner image even if it is the case where a recording material which already has a toner image fixed by passing through a plurality of heating portions is resupplied to the transfer portion.

According to an aspect of the present invention, there is provided an image forming apparatus comprising an image bearing member for carrying a toner image; transferring means for being supplied with a transfer voltage to transfer a toner image from said image bearing member onto a recording material in a transfer portion; a plurality of heating devices for heating the toner image transferred onto the recording material, wherein heating conditions of said heating devices are different from each other; refeeding means for refeeding the recording material to said transfer portion to transfer a toner image onto the recording material having a toner image fixed by said heating device; glossiness selecting means for selecting a glossiness of the toner image after fixing; heating device determinating means for determining the heating device to heat the toner image from said heating devices in accordance with the glossiness selected by said glossiness selecting means; and voltage changing means for changing the transfer voltage for transferring the toner image onto the refed recording material in accordance with the heating device having heated the toner image on the recording material prior to the recording material being refed by said re-sheet feeding means.

According to another aspect of the present invention, there is provided an image forming method comprising a step of transferring a toner image onto a recording material in a transfer portion; a step of setting heating different conditions to heating devices for heating the toner image; a step of refeeding the recording material to said transfer portion to transfer a toner image onto the recording material having a toner image fixed by said heating device; a step of selecting a glossiness of the toner image after fixing; a step of determining a heating device to heat the toner image from a plurality of heating devices in accordance with the glossiness selected by said glossiness selecting step; and a step of changing the transfer voltage for transferring the toner image onto the refed recording material in accordance with the heating device having heated the toner image on the recording material prior to the recording material being refed by said refeeding step.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
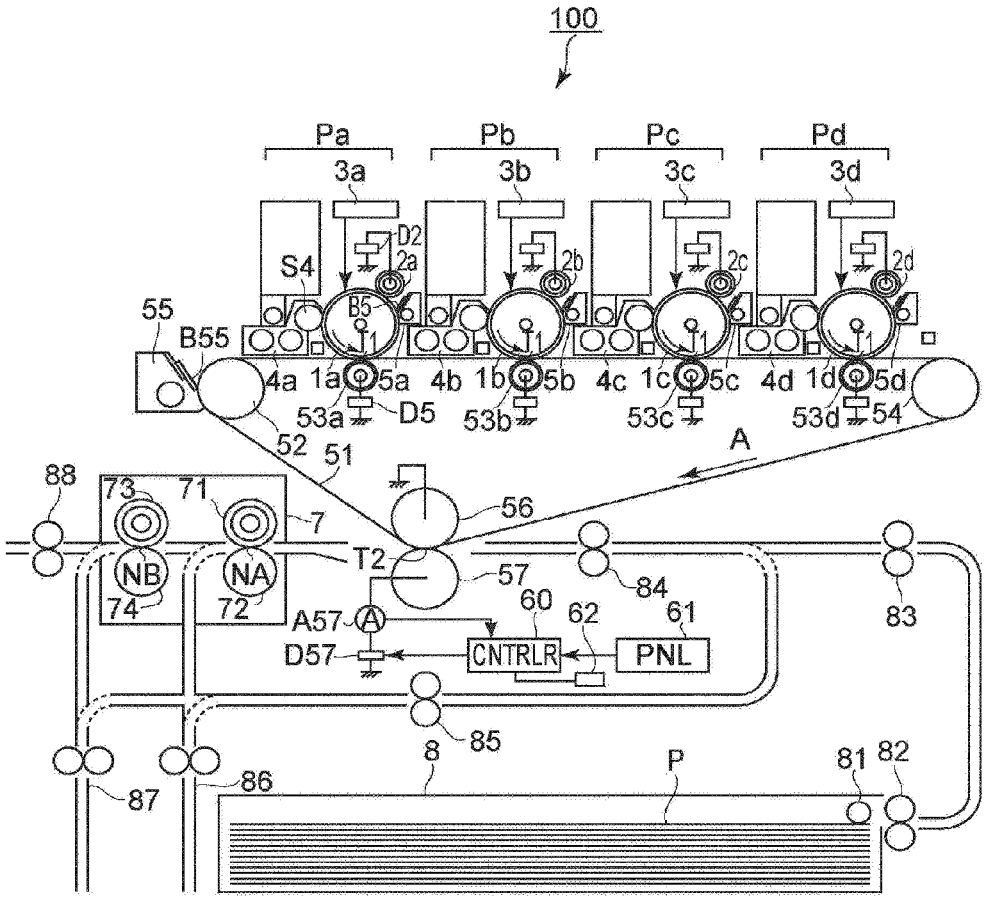
FIG. 1 is an illustration of an image forming apparatus of a first embodiment.

Hereinafter, the embodiments of the present invention will be described in the detail referring to the drawings in an image forming apparatus of the present invention, except for setting a transfer voltage at the time of transferring a toner image onto a recording material from an image bearing member including an intermediary transfer member, some or all of the structure of each embodiment may be replaced by alternative structure thereof the present invention is not limited to a tandem type full color image formation device rather it is applicable also to the image forming apparatus which is provided with a plurality of developing devices for one photosensitive member in addition, the three or less photosensitive members for an intermediary transfer member or a recording material feeding member may be provided. In this embodiment, only the main parts relevant to the formation/transferring of the toner image will be described. However, the present invention is applicable to the various usages, such as a printer, a copying machine, a facsimile machine, and a composite machine and so on, by the suitable equipment, equipment, and casing structure being added.

The illustration is omitted as for known constituent members, voltage source, material, process control, and so on of the image forming apparatus.

First Embodiment

Figure 2:
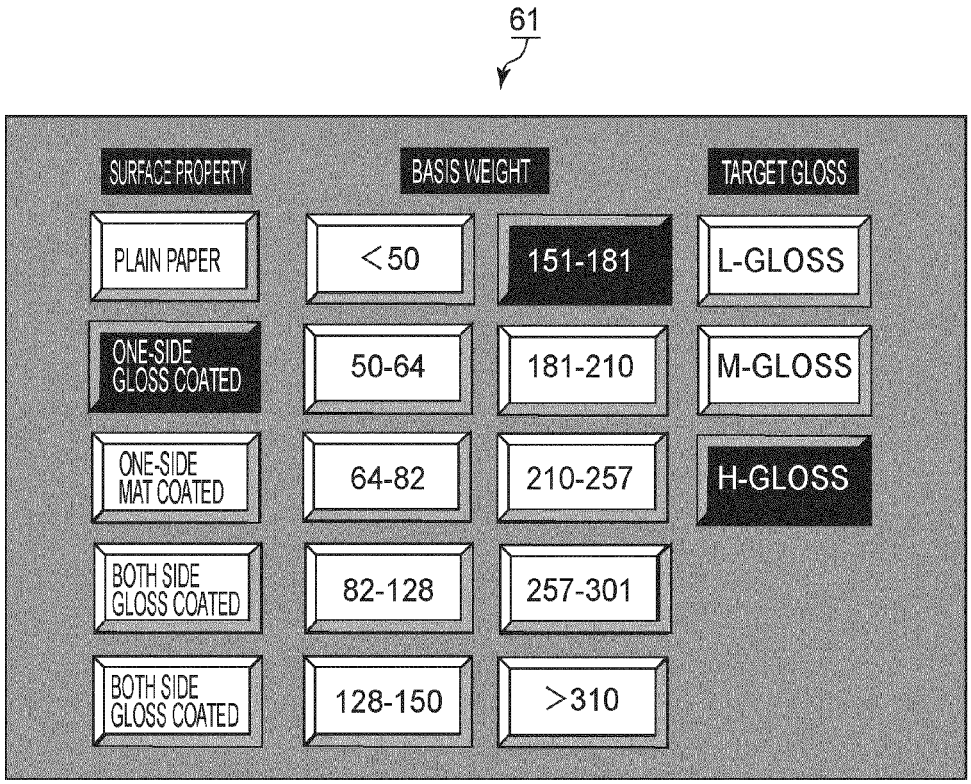
FIG. 2 is an illustration of † of an operation panel for setting a fixing condition.
Figure 3:
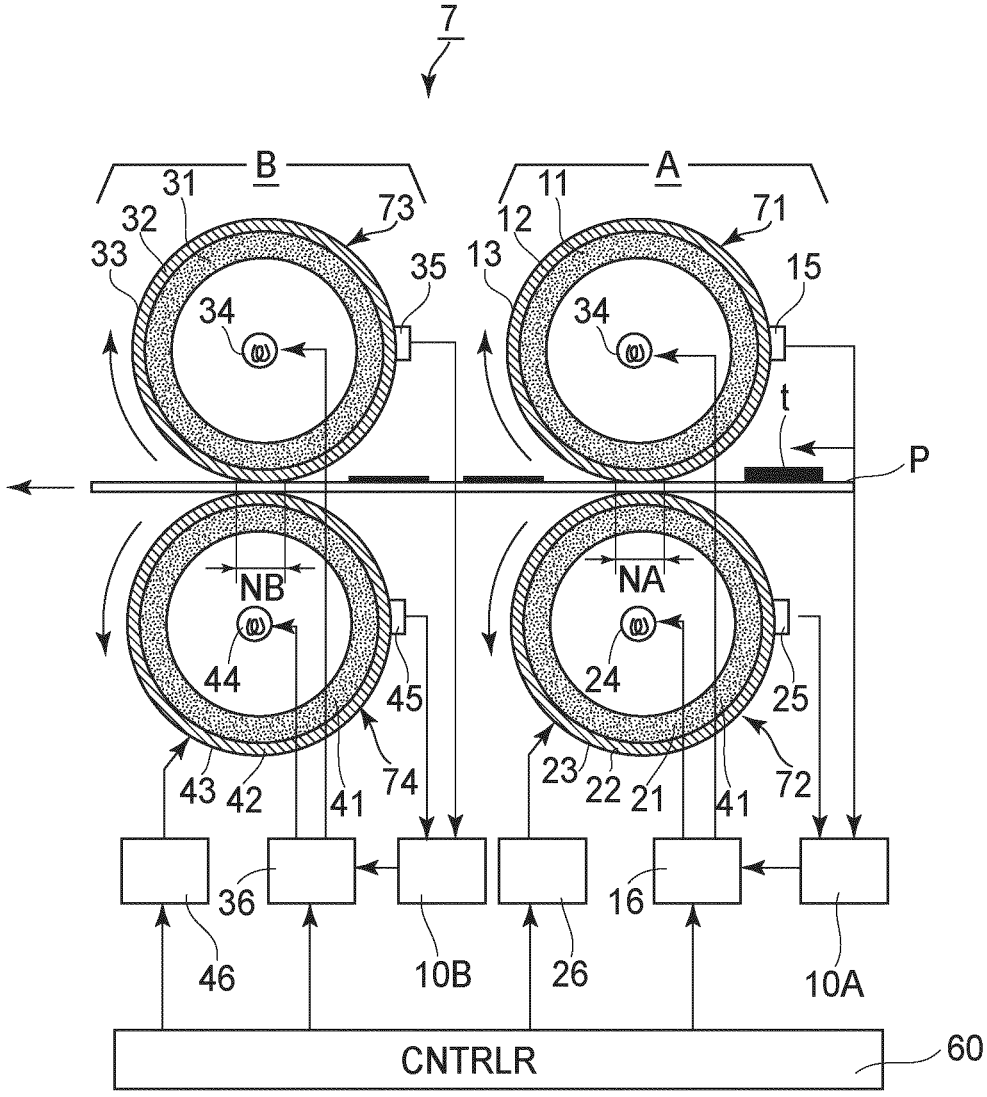
FIG. 3 is an illustration of † of a fixing device.

FIG. 1 is an illustration of an image forming apparatus of a first embodiment, FIG. 2 is an illustration of an operation panel for setting a fixing condition, and FIG. 3 is an illustration of a fixing device.

As shown in FIG. 1, the image forming apparatus 100 comprises voltage adjustment means (60) for adjusting the transfer voltage at the time of transferring the toner image onto a resupplied recording material P in response to the number of the heating portions (NA, NB) through which the recording material P has passed. The voltage adjustment means (60) adjusts transfer voltage in response to the kind of recording material P used (Table 2).

Image forming stations for magenta, cyan, yellow, and black colors Pa, Pb, Pc, Pd are arranged in a straight line section of an intermediary transfer belt 51, in series in the image forming apparatus 100. The intermediary transfer belt 51 is stretched around a driving roller 52, a tension roller 54, and an internal secondary transfer roller 56. It is driven by the driving roller 52 driven by an unshown driving motor, and is circulated in the direction of an arrow A. The intermediary transfer belt 51 comprises conductive resin or dielectric resin material such as polycarbonate, polyethylene terephthalate resin film, and polyvinylidene fluoride resin film. It is an endless belt member. In the first embodiment, the intermediary transfer belt 51 is made of the electroconductive polyimide.

The image forming stations Pa, Pb, Pc, Pd comprise the similar structure except differing in the color (magenta, cyan, yellow, black) of the toner filled in the developing devices 4*a*, 4*b*, 4*c*, 4*d*. For this reason, the magenta image forming station Pa will be described hereinafter. The other image forming stations Pb, Pc, Pd will be understood by reading the suffix "a" as "b", "c" or "d".

The image forming station Pa is provided with a photosensitive drum 1*a* (image bearing member) which is a rotatable electrophotographic photosensitive member in the form of a drum. Around the photosensitive drum 1*a*, a primary charger 2*a*, an exposure device 3*a*, a developing device 4*a*, a transfer roller 53*a*, and a cleaning device 5*a*, are disposed. In the first embodiment, as will be described hereinafter, a process speed (peripheral speeds of the photosensitive drum 1*a* and the intermediary transfer belt) is constant 300 mm/sec irrespective of a single side printing mode, a double-side printing mode, a low gloss setting, an intermediate gloss setting, a high gloss setting or the like.

The primary charger 2*a* charges the surface of the photosensitive drum 1*a* to a uniform potential. The exposure device 3*a* drives the light source by the image signal corresponding to the magenta component color component of the original, and imagewisely exposes the surface of the photosensitive drum 1*a* charged uniformly by deflecting exit light therefrom by a polygonal mirror by this, an electrostatic latent image is formed.

The developing device 4*a* carries the toner charged electrically on a developing sleeve S4, and applies developing voltage to the developing sleeve S4. By doing so, the toner is electrically transferred from the developing sleeve S4 to the electrostatic latent image of the photosensitive drum 1*a*, so that the electrostatic latent image is developed into a toner image.

A transfer roller 53*a* which is an example of the transferring means is supplied with a transfer voltage from a transfer power source D5 so that a transfer electric field is formed in a transfer portion T1 by this, the toner image is transferred onto an intermediary transfer belt 51 in accordance with the transfer electric field on the photosensitive drum 1*a*.

The cleaning device 5*a* comprises a cleaning blade B5, which scrapes off the surface of the photosensitive drum 1*a* the toner image which has passed the transfer portion T1 without transferring onto the intermediary transfer belt 51.

The magenta toner image formed on the photosensitive drum 1*a* is transferred primarily onto the intermediary transfer belt 51 with the transfer roller 53*a*. The magenta toner image is fed to the transfer portion T1 for the photosensitive drum 1*b* with the movement of the intermediary transfer belt 51. By this time, a cyan toner image is formed through the process similar to that for the magenta toner image on the photosensitive drum 1*b*. The cyan toner image is transferred superimposingly onto the magenta toner image on the intermediary transfer belt 51 (primary transfer). Similarly, a yellow toner image is transferred superimposingly in the transfer portion T1 for the photosensitive drum 1*c*. In addition, a black toner image is transferred superimposingly in the transfer portion T1 for the photosensitive drum 1*d*. A four color toner image formed by carrying out in this manner is fed to a secondary transfer portion T2 together with the movement of the intermediary transfer belt 51, and it is transferred all together to the recording material P (secondary transfer).

In the first embodiment, the toner is charged to the negative polarity, and the toner image is formed through a reverse development type. For example, the surface of the photosensitive drum 1*a* is electrically charged by the primary charger 2*a* to the negative polarity of −500V, and, thereafter, the portion exposed by the exposure device 3*a* is electrically discharged to −150V. A developing voltage of 350V is applied to the developing sleeve S4, and the toner charged to the negative polarity is deposited to the electrically discharged portion of the photosensitive drum 1*a*. And, the transfer power source D5 outputs 300V to the transfer roller 53*a*, so that the toner image charged to the negative polarity transfers onto the intermediary transfer belt 51.

The recording material P is fed to a secondary transfer portion T2 in synchronism with the toner image on the intermediary transfer belt 51. The recording material P is stacked in a feeding cassette 8, and it is fed one by one by a pick-up roller 81 and a separation roller 82. It is fed by a feeding roller 83, and it is stopped by registration rollers 84. The registration rollers 84 feed the recording material P to the secondary transfer portion T2 in synchronism with the top of the toner image on the intermediary transfer belt 51.

A secondary transfer portion T2 is formed between the external secondary transfer roller 57 and the intermediary transfer belt 51 by an external secondary transfer roller 57 being urged to an internal secondary transfer roller 56 through the intermediary transfer belt 51. An outer diameter of the external secondary transfer roller 57 is 24 mm, and it comprises a core metal of 12 mm, and a coating layer of the semi-electroconductive rubber of thickness 6 mm. The resistance thereof is 1×10^7^-3×10^7^ ohms (2 kV; temperature of 23 degrees C., 50% of humidity).

Figure 7:
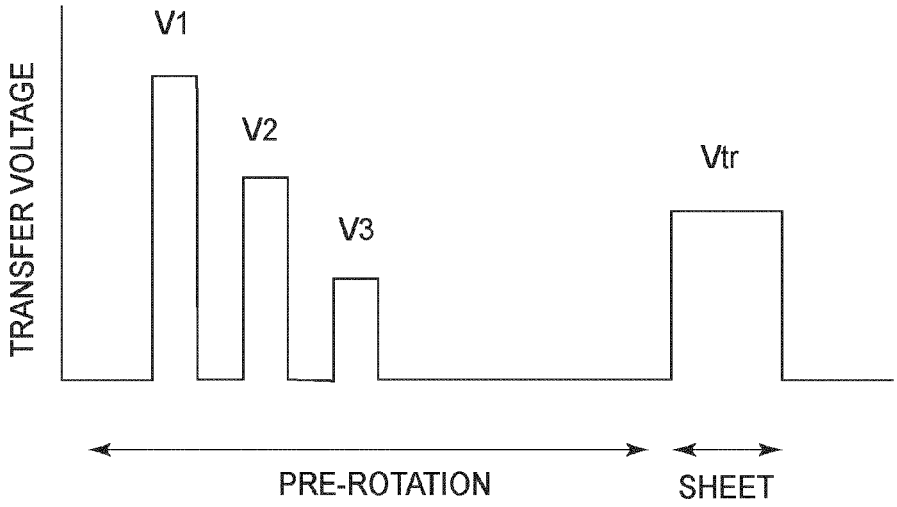
FIG. 7 is an illustration of a transfer voltage setting including a resistance measurement of a transfer portion in a third embodiment.

The internal secondary transfer roller 56 is connected to the ground potential. On the other hand, the external secondary transfer roller 57 is supplied with the transfer voltage (in the first embodiment, positive polarity, +3300-+4600V) having the polarity opposite to that of the charge polarity of the toner image from the transfer power source D57. When a transfer voltage is applied to the external secondary transfer roller 57, the transfer electric field acts on the recording material P nipped and fed by the secondary transfer portion T2 and on the toner image superimposed thereon the four color toner image is transferred, in accordance with the transfer electric field, all together onto the recording material P from the intermediary transfer belt 51 (secondary transfer). Transfer voltage is a constant voltage, as will be described hereinafter, set by a controller (voltage adjustment means) 60. A current detecting circuit A57 senses a current value which flows into the secondary transfer portion T2 from the transfer power source D57. The controller 60 outputs a constant voltage for resistance measurement from the transfer power source D57 during non-transfer period, and senses the resistance of the secondary transfer portion T2 (FIG. 7). Untransferred toner on the intermediary transfer belt 51 which passed the secondary transfer portion T2 without transferring onto recording material P, is fed to a cleaning device 55, and is scraped off by a cleaning blade B55.

The recording material P having received the toner image (secondary transfer) in secondary transfer portion T2 is fed to the fixing device 7. In the fixing device 7, the toner image is fixed on the surface of the recording material P with the heat and the pressure. The fixing device 7 comprises two fixing nips NA, NB which can be closed and opened, and these are disposed in series. Between the fixing nips NA, NB and downstream of the fixing nip NB, a transportation guide mechanism which can change the feeding path between the linear direction and downward direction (the inverting pass 86, 87 directions) is provided by an unshown flapper mechanism.

When the single side printing mode is selected, the controller 60 controls the transportation guide mechanism to discharge the recording material P which has the fixed toner image through discharging rollers 88 to an unshown stacking tray.

<Double-Side Printing Mode>

The image forming apparatus 100 has inverting passes 86 and 87 and feeding rollers 85 which are the examples of resupply means. When a double-side printing mode is selected, the controller 60 switches back the recording material P which has the toner image fixed by the fixing device 7 by the inverting pass 86 (or 87) to feed it to the feeding rollers 85. The recording material P is fed to the secondary transfer portion T2 from the registration roller 84 in the face-reversion state, and a toner image is transferred onto a back side thereof there.

<Operation Panel>

The image forming apparatus 100 has an operation panel 61 (glossiness selecting means), and the user can set thereon paper kind mainly expressed by the surface property of the recording material P, the basis weight indicating the thickness (weight per unit area of paper) of paper, and desired glossiness of the fixed image. The paper kind, the basis weight, and the glossiness which are set are fed from the operation panel 61 to the controller 60 they are reflected in the image forming condition in the image forming station Pa, Pb, Pc, Pd, the transfer condition (output setting of the transfer power source D57) in the secondary transfer portion T2, and the fixing condition in the fixing device 7. The settings of the paper kind, the basis weight, and the glossiness can also be inputted to the controller 60 with an image formation job.

As shown in FIG. 2, the paper kind which can be selected on the operation panel 61 includes the plain paper, the one surface gloss coated paper, the one surface mat coated paper, the double-sided gloss coated paper, and the double-sided mat coat (5 modes). In addition, the basis weights which can be selected include less than 50 g/m$^2$, 50-64 g/m2, 64-82 g/m$^2$, 82-128 g/m$^2$, 128-150 g/m$^2$ 151-181 g/m$^2$, 181-210 g/m$^2$, 210-257 g/m$^2$, 257-301 g/m$^2$, 301 g/m$^2$ or higher (10 modes). Furthermore, the glossinesses (target gloss) which can be selected are low gloss, middle gloss, and high gloss (three steps).

In FIG. 2, on the operation panel 61, the one surface gloss coat, basis weight of 151 g/m$^2$-181 g/m$^2$, and the high gloss are selected.

<Fixing Device>

As shown in FIG. 1, the fixing device (heater) 7 of the image forming apparatus 100 includes two fixing nips NA, NB. The controller 60 which is an example of the setting means determines a combination (three combinations) of the two fixing nips NA, NB in response to the selections on the operation panel 61. A fixing roller 71 and a pressing roller 72 can be switched between a press-contact state and a spacing state in the fixing nip NA. They are press-contacted to each other at the time of the low gloss setting and the high gloss setting. At the time of the middle glossiness setting, they are spaced from each other. A fixing roller 73 and a pressing roller 74 can be switched between a press-contact state and a spacing state in the fixing nip NB. They are press-contacted to each other at the time of the middle glossiness setting and the high gloss setting. At the time of the low gloss setting, they are spaced from each other. Therefore, at the time of the low gloss setting, the fixing operation is carried out in the fixing nip NA, and the fixing operation is carried out by the fixing nip NB at the time of the inside gloss setting. At the time of the high gloss setting, the toner image is fixed or half-fixed by the fixing nip NA, and, thereafter, the recording material P is heated and pressed by the fixing nip NB by this The glossiness of the image is increased and/or the fixing is assured.

The controller (heater selecting means) 60 selects the combination of the fixing nip NA, NB used in response to the selection of the glossiness on the operation panel 61. With such a structure, the image output corresponding to the glossiness selected by the user is accomplished without requiring the change of a transfer speed and fixing speed as shown in JP,2000-221821,A.

As shown in FIG. 3, the fixing device 7 is of a tandem fixing type with which the fixing nip NA and the fixing nip NB are arranged linearly. The fixing device 7 includes the fixing unit A including the fixing nip NA formed by the fixing roller 71 and the pressing roller 72, and the fixing unit B including the fixing nip NB formed by the fixing roller 73 and the pressing roller 74. The fixing nip NA is controlled in temperature by control means (15, 16, 25, 14, 24, 26), and the fixing nip NB is controlled in temperature by control means (35, 36, 45, 34, 44, 46). A spacing mechanism 26 carries out the selective usage of the fixing unit A by the controller 60 controlling the press-contact and spacing of the pressing roller 72 relative to the fixing roller 71. The spacing mechanism 46 carries out the selective usage of the fixing unit B by controlling by the controller 60 controlling the press-contact and spacing of the pressing roller 74 relative to the fixing roller 73.

The fixing roller 71 comprises the an aluminum core metal 11 which has 1.0 mm in thickness, and the an elastic layer 12 of silicone rubber which has 500 micrometers in thickness it further comprises a parting layer 13 of a PFA tube which has 20 micrometers in thickness, thereon. It has an outer diameter of 45 mm. A halogen heater 14 as a heating source is provided inside the fixing roller 71. A thermistor 15 for sensing a surface temperature of the fixing roller 71 in a noncontact state is provided outside the fixing roller 71.

The pressing roller 72 comprises an aluminum core metal 21 which has a 1.0 mm in thickness, and an elastic layer 22 of silicone rubber which has 500 micrometers in thickness, and it comprises a parting layer 23 of a PFA tube which has 20 micrometers in thickness, thereon. It has an outer diameter of 30 mm. A halogen heater 24 as a heating source is provided inside the pressing roller 72. A thermistor 25 for sensing a surface temperature of the pressing roller 72 by non-contact is provided outside the pressing roller 72.

The state of the fixing roller 71 and the pressing roller 72 can be selected between the press-contact state and the spacing state by the spacing mechanism 26. When the spacing mechanism 26 press-contacts the fixing roller 71 and the pressing roller 72 to each other, the fixing nip NA is established in the fixing unit A. The fixing roller 71 and the pressing roller 72 rotate with an unshown driving mechanism in the direction of the arrows.

The wattage, at the time of AC100V application, of the halogen heaters 14 and 24 is 800 W in the halogen heater 14, and is 400 W in the halogen heater 24. A control circuit 10A is electrically connected with the halogen heaters 14 and 24 through thermistors 15 and 25 and a power circuit 16. Normally, the control circuit 10A controls the halogen heater 14 on the basis of the result of detection of the thermistor 15, and controls the halogen heater 24 on the basis of the result of detection of the thermistor 25. In this manner, the temperature control for the fixing roller 71 and the pressing roller 72 is effected. The control circuit 10A controls the temperature of the fixing nip NA at 170 degrees which is lower than the temperature of the fixing nip NB to decrease heating quantity relatively. The fixing roller 73 comprises an aluminum core metal 31 which has a 1.0 mm in thickness, and an elastic layer 32 of silicone rubber which has 500 micrometers in thickness, and comprises a parting layer 33 of 20-micrometer-thick PFA tube, thereon. It has an outer diameter of 45 mm. A halogen heater 34 as a heating source is provided inside the fixing roller 73. A thermistor 35 for sensing a surface temperature of the fixing roller 73 in a noncontact state is provided outside the fixing roller 73.

The pressing roller 74 comprises an aluminum core metal 41 which has a 1.0 mm in thickness, and an elastic layer 42 of silicone rubber which has 500 micrometers in thickness it further comprises a parting layer 43 of a PFA tube which has 20 micrometers in thickness, thereon. It has an outer diameter of 30 mm. A halogen heater 44 as a heating source is provided in the pressing roller 74. A thermistor 45 for sensing a surface temperature of the pressing roller 74 in a non-contact state is provided outside the pressing roller 74.

The fixing roller 73 and the pressing roller 74 can be selected between the press-contact state and the spacing state by the spacing mechanism 46. When the spacing mechanism 46 press-contacts the fixing roller 73 and the pressing roller 74 to each other, the fixing nip NB of the fixing unit B is established. The fixing roller 73 and the pressing roller 74 rotate with an unshown driving mechanism in the directions of arrows.

The wattage, at the time of AC100V application, of the halogen heaters 34 and 44 is 800 W in the halogen heater 34, and is 400 W in the halogen heater 44. A control circuit 10B is electrically connected to the halogen heaters 34 and 44 through thermistors 35 and 45 and a power circuit 36. Normally, the control circuit 10B controls the halogen heater 34 on the basis of the result of detection of the thermistor 35, controls the halogen heater 44 on the basis of the result of detection of the thermistor 45, to effect the temperature control of the fixing roller 73 and the pressing roller 74. The control circuit 10B controls the temperature of the fixing nip NB at 195 degrees which is higher than the temperature of the fixing nip NA to increase heating quantity relatively.

In the single side printing mode & high glossiness setting, the controller 60 introduces the recording material P which has passed the fixing nip NA of the fixing unit A in the press-contact state into the fixing nip NB of the fixing unit B, and the recording material is nipped and fed by the nip.

In the single side printing mode & middle glossiness setting, the controller 60 stops the electric power supply to the halogen heaters 14 and 24 of the fixing unit A the recording material P which has passed the fixing nip NA in the spacing state is introduced into the fixing nip NB of the fixing unit B, and the recording material is nipped and fed by the nip.

In the single side printing mode & low glossiness setting, the controller 60 introduces the recording material P which has passed the fixing nip NA of the fixing unit A of the press-contact state into the fixing nip NB of the fixing unit B of the spacing state however, the halogen heaters 34 and 44 of the fixing unit B are not supplied with the electric power at this time.

<Transfer Voltage Control at the Time of Double-Side Printing Mode>

Figure 4:
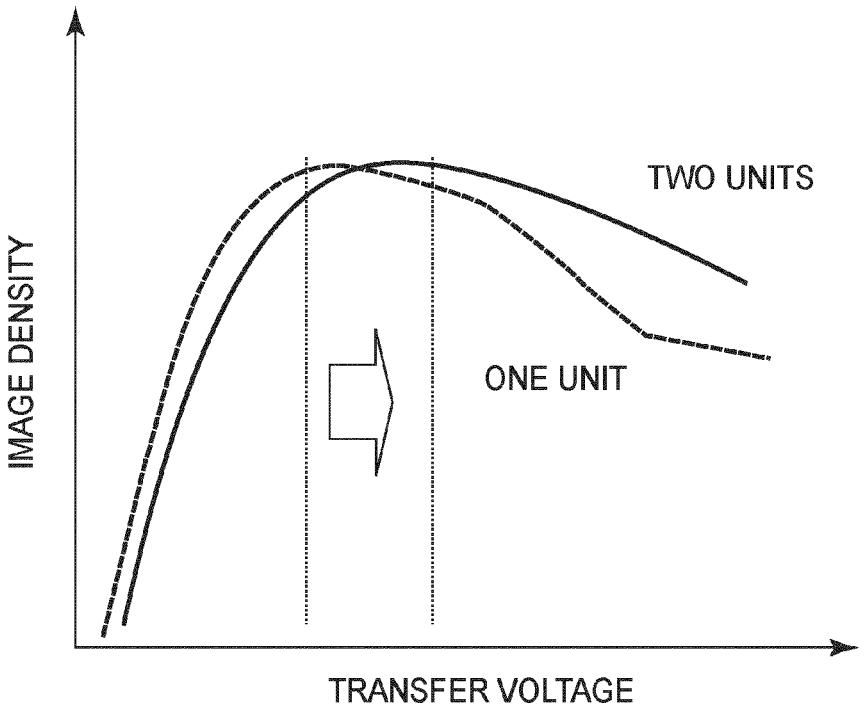
FIG. 4 is a diagram illustrating a relation between a transfer voltage in a recording material which has different fixing conditions and an image density.

FIG. 4 is a diagram illustrating a relation between a transfer voltage and an image density in the recording material which has the different fixing condition.

In the double-side printing mode & high glossiness setting, resupply of the recording material P heated by both fixing nips NA, NB is carried out by way of the inverting pass 87 to the secondary transfer portion T2.

In the double-side printing mode & low glossiness setting, resupply of the recording material P heated by the fixing nip NA is carried out by way of the inverting pass 86 to the secondary transfer portion T2. At this time, the halogen heaters 34 and 44 of the fixing unit B are not supplied with the electric power.

In the double-side printing mode & middle glossiness setting, the halogen heater 14 of the fixing roller 71 and the halogen heater 24 of the pressing roller 72 are not supplied with the electric power, but the nip NA is in the spacing state. The recording material P passes idly between the fixing roller 71 and the pressing rollers 72, and the recording material P heated by the fixing nip NB is resupplied to the secondary transfer portion T2 by way of the inverting pass 87. The heating portion in the present invention means the fixing nip with which the electric power is supplied to the heater of the fixing roller or the pressing roller and so on. For this reason, as in the case of the double-side printing mode & low glossiness setting, the fixing nip (non-heat-fixing state) with which the electric power does not be supplied substantially to the heater of the fixing roller or the pressing roller is not the heating portion in this meaning.

In the image forming apparatus 100, the glossiness of the surface image can be controlled by the combination of the fixing unit A, B used in order to fix the toner image transferred onto the front surface of the recording material. However, since the moisture contents of the recording material after the fixing P differ depending on the combination of the fixing unit A, B used, the moisture contents of the recording material P differ between the event of the transferring onto the front surface of the recording material P, and the event of the transferring onto the back side. It has been revealed that the change of the moisture content of the recording material P results in the change of the electric resistance of the recording material P, and it is influenced to the abnormal discharge produced in the void portion of the recording material P.

Therefore, in order to provide the optimal image also in the back side, a proper transfer voltage different from that at the time of the transferring of the front surface, is required. Table 1 is the result of a measurement of the moisture contents before and after the fixing, and glossinesses after the fixing investigated about the recording material of four-kind five types. In each of the following table and descriptions, the recording material A are CLC sheets (registered Trademark) available from Nippon Paper Industries (registered Trademark) which are two kinds of typical plain paper and which are standard paper in the company of the assignee of the subject application the basis weight thereof are 105 g/m$^2$ and 157 g/m$^2$, respectively. The recording material B is Noyzidra (phonetical, registered Trademark) available from Nippon Paper Industries (registered Trademark), and has a basis weight of 250 g/m$^2$. The recording material C is four cc art paper (registered Trademark) which is the double-sided coated paper available from Nippon Paper Industries (registered Trademark), and has a basis weight of 170 g/m$^2$. The recording material D is OK top coating paper (registered Trademark) available from Nippon Paper Industries (registered Trademark), and has a basis weight 105 g/m$^2$.

TABLE 1

| Fixing condition, moisture content and glossiness (glossiness) | | | | |
|---|---|---|---|---|
| Paper g/m$^2$ | Before fixing | One ustrm device L gloss | One dwnstrm device M gloss | Both (two) devices H gloss |
| A(105) | 5.1% | 3.4% (20) | 3.0% (25) | 2.8% (32) |
| A(157) | 6.0% | 3.6% (18) | 3.0% (24) | 2.4% (30) |
| B(250) | 5.6% | 4.5% (16) | 4.0% (23) | 3.3% (28) |
| C(170) | 4.1% | 2.5% (20) | 2.3% (30) | 2.1% (40) |
| D(105) | 5.4% | 3.3% (24) | 2.7% (31) | 2.0% (43) |

In Table 1, the moisture content of the recording material was measured by MX5000 (registered Trademark) available from Infrared Engineering Co. (registered Trademark) as for the glossiness, the monochromatic solid image of the cyan was measured with 60 PG1 incident angles by the handy glossiness meter (registered Trademark) available from Nippon Denshoku (registered Trademark).

FIG. 4 is about the recording material A of the basis weight 157 g/m$^2$ it shows the relation between the secondary transfer voltage and the image density after the fixing, at the time of the toner image being transferred secondarily onto the back side of the recording material P after the fixing of one surface image, in the case of using one fixing unit A is used, and in the case of using both fixing units A and B. As shown in FIG. 4, the moisture content of the recording material A having the fixed front side image depends on the number of the fixing units B used for the fixing and therefore, a secondary transfer voltage which provides the maximum image density (the maximum transfer efficiency) differs. For this reason, the secondary transfer voltage in the case of using one fixing device differs from the secondary transfer voltage in the case of using two fixing devices. That is, it is preferable to make the secondary transfer voltage different between when the number of the passed fixing nips is one and when it is two. In addition, when the recording material is dried, the abnormalities in the discharging that a part of half tone is not transferred tends to occur and therefore, it is preferable that the proper value of secondary transfer voltage is set for every type and kind of recording material A. Particularly, the abnormalities in the discharging attributable to the unsmoothness of the surface in the case of non-coated paper are remarkable and therefore, it is preferable to change the setting of secondary transfer voltage correspondingly to the surface property of the recording material.

Table 2 shows the set points, for the various recording materials, of the transfer voltage at the time of the front surface transferring in double-side printing mode (single side printing mode), and at the time of the back side transferring in double-side printing mode under a low humidity ambient condition (5%, 23-degree C. With the increase of the basis weight of the recording material, the change amount of the transfer voltage corresponding to the fixing condition is reduced. In addition, the change amount of the transfer voltage in the case of the coated paper having a high surface property is small. By this, the substantially equal transferring quality can be assured. For this reason, the table corresponding to the basis weight and the surface property is provided as shown in Table 2.

TABLE 2

| Fixing condition and secondary transfer voltage | | | | |
|---|---|---|---|---|
| Paper g/m$^2$ | One-side | 2nd after one ups device L gloss | 2nd after one dwns device M gloss | 2nd after both devices H gloss |
| A(105) | 3300 V | 3600 V | 3700 V | 3800 V |
| A(157) | 3900 V | 4200 V | 4300 V | 4400 V |
| B(250) | 4300 V | 4500 V | 4500 V | 4600 V |
| C(170) | 4000 V | 4200 V | 4300 V | 4500 V |
| D(105) | 3400 V | 3800 V | 4000 V | 4200 V |

As described above, corresponding to the moisture content of the paper changed correspondingly to the combination of the fixing unit at the time of the front surface fixing A, B, the controller (voltage changing means) 60 changes the set point (absolute value) of the transfer voltage at the time of the back side transferring. In this manner, the poor images which may occur depending on the glossiness setting set by the user, such as the "coarse image" and the "white void", are prevented, and the optimal image formation can be provided also on the back side.

<Correction of Transfer Voltage Based on Ambient Condition>

The image forming apparatus 100 has an ambient condition sensor 62 for sensing the ambient condition. The voltage adjusting means (60) adjusts the set point (absolute value) of the transfer voltage correspondingly to the result of detection of the ambient condition sensor 62 (Table 3).

The moisture content of the recording material changes with temperature and relative humidity (ambient condition) conditions and therefore, the table which not only the surface property and the basis weight of the recording material as shown in Table 2 but also the temperature and relative humidity conditions are taken into the consideration in the setting of the transfer voltage at the time of the back side transferring is provided, and a still more satisfactory results are provided. Table 3 is an example of the setting table for the secondary transfer voltage changed correspondingly to the environmental (temperature and relative humidity) conditions and the fixing condition, when the image is formed on the recording material A having a basis weight of 157 g/m$^2$.

TABLE 3

| Paper A(157 g/m$^2$) Control of secondary transfer voltage | | | | |
|---|---|---|---|---|
| Ambience | One-side | 2nd after one ups device L gloss | 2nd after one dwns device M gloss | 2nd after both devices H gloss |
| L.H. (23° C. 5%) | 3900 V | 4200 V | 4300 V | 4400 V |
| Nor. (23° C. 50%) | 2100 V | 2200 V | 2300 V | 2400 V |
| H.H. (30° C. 80%) | 1100 V | 1200 V | 1300 V | 1350 V |

<Example of Three Fixing Units>

In the first embodiment, the image forming apparatus 100 which has two fixing nips NA, NB is used. However, in the image forming apparatus which has three or more of the fixing nips which are disclosed in JP,2000-221821,A, it is preferable to set the value (absolute value) of the secondary transfer voltage at the time of the back side transferring in double-side printing mode, correspondingly to number and combination of the fixing nips used for the fixing of front side image.

Here, the example of the fixing device with which the three sets of the fixing unit A used for the first embodiment are disposed in series will be described. The value (absolute value) of the secondary transfer voltage at the time of the back side transferring after fixing the front side image is set as shown in Table 4 with respect to the one set case, the two set case, and the three set case (three conditions). Table 4 is the table (under ambient condition of 23 degree C of temperature and 5% of relative humidity) at the time of using one/two/three fixing units with respect to the recording materials A of the basis weight 105 g/m$^2$ and the basis weight 157 g/m$^2$.

TABLE 4

| secondary transfer voltage with 3 fixing devices | | | | |
|---|---|---|---|---|
| Paper g/m$^2$ | One-side | 2nd after one ups device L gloss | 2nd after one dwns device M gloss | 2nd after both devices H gloss |
| A(105) | 3300 V | 3600 V | 3800 V | 3900 V |
| A(157) | 3900 V | 4200 V | 4400 V | 3400 |

Here, the example of the fixing device with which the three sets of the fixing unit A used for the first embodiment are disposed in series will be described. The value (absolute value) of the secondary transfer voltage at the time of the back side transferring in fixing the front side image is set as shown in Table 4 with respect to the one set case, the two set case, and the three set case (three conditions). Table 4 is the table (temperature of the 23 degrees C and 5% of relative humidity) at the time of using the one/two/three fixing units with respect to the recording material A of the basis weight 105 g/m$^2$ and the basis weight 157 g/m$^2$.

<Example Other than Back Side Printing>

In the first embodiment, at the time of transferring the toner image on the back side, after the toner image is transferred and fixed on the front surface, the secondary transfer voltage is controlled. However, if the transferring of the 2nd toner image is the transferring to the same recording material as at the time of the 1st toner image transferring, the present invention is applicable, and the 2nd transferring is not limited to the transferring to the back side of the recording material. The present invention is applicable also to the transfer voltage in the case of transferring the toner image, under a low temperature condition, onto the same front surface after fixing under a high temperature condition.

In addition, the present invention is applicable when it forms the image which has a plurality of glossinesses on the one surface of recording material, and it changes the transfer bias voltage at the time of the second image formation in response to the fixing condition for the first fixing operation. The image which has the glossinesses of the plural levels is accomplished by effecting the image formation twice on the one surface of the recording material. In more detail, the high glossiness output is carried out in the first time image formation, and the low glossiness image output is carried out in the second time image formation.

In these cases, similarly to the first embodiment the poor images which may be produced by the glossiness setting set by the user, such as the "coarse image" and the "white void", are prevented, and the optimal image formation can be provided also in the back side In the image forming apparatus with which the number of the fixing unit to be used is changed correspondingly to the glossiness selected by the user, the value (absolute value) of the transfer voltage of the toner image formed in the second image formation in response to the number of the fixing units used in the first image formation is changed so that the possibility of the improper transfer is prevented.

In the first embodiment, required transfer current Ib (third embodiment) does not depend on the fixing condition. However, the set points may be set more finely in response to the property (the resistance of the intermediary transfer belt, the resistance of the secondary transfer roller, the toner property) of the image forming apparatus.

Second Embodiment

Figure 5:
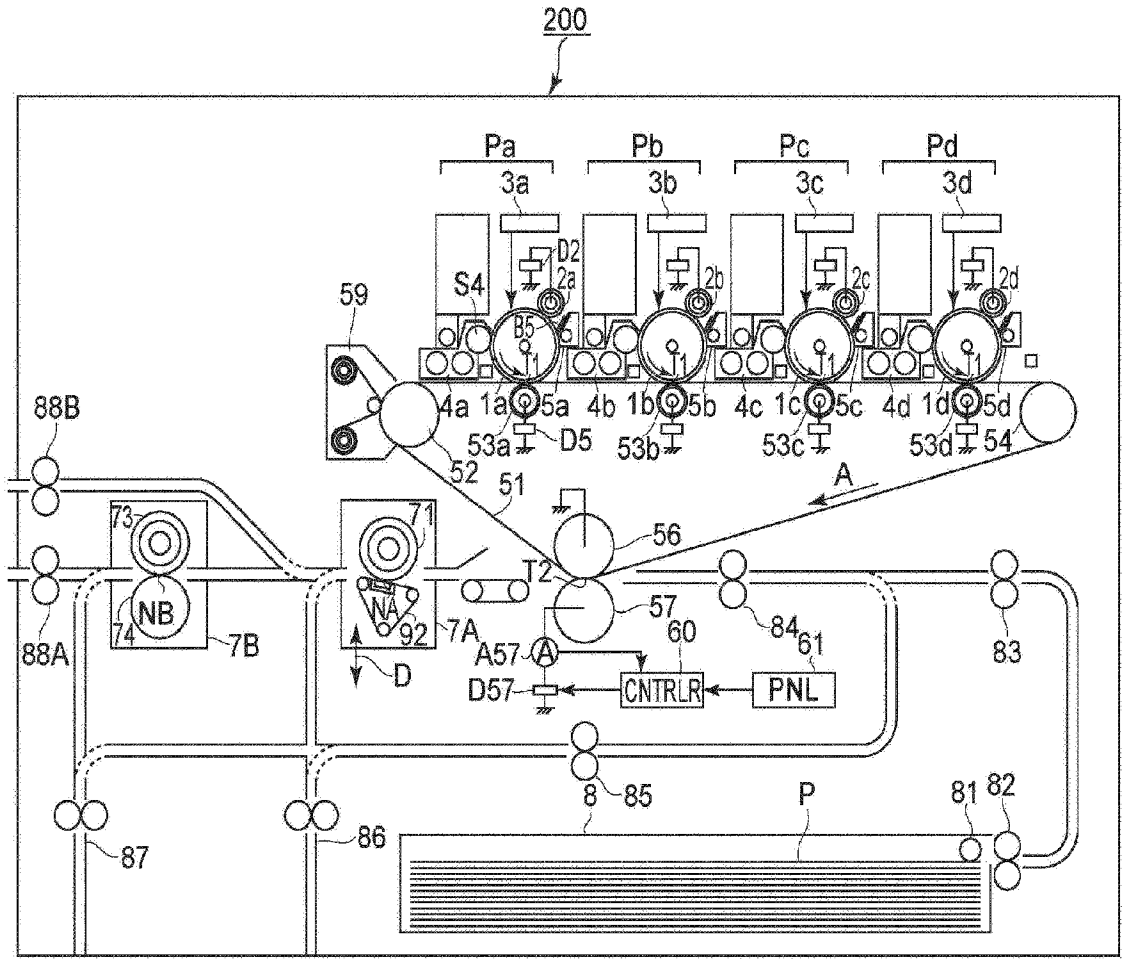
FIG. 5 is an illustration of an image forming apparatus of a second embodiment.
Figure 6:
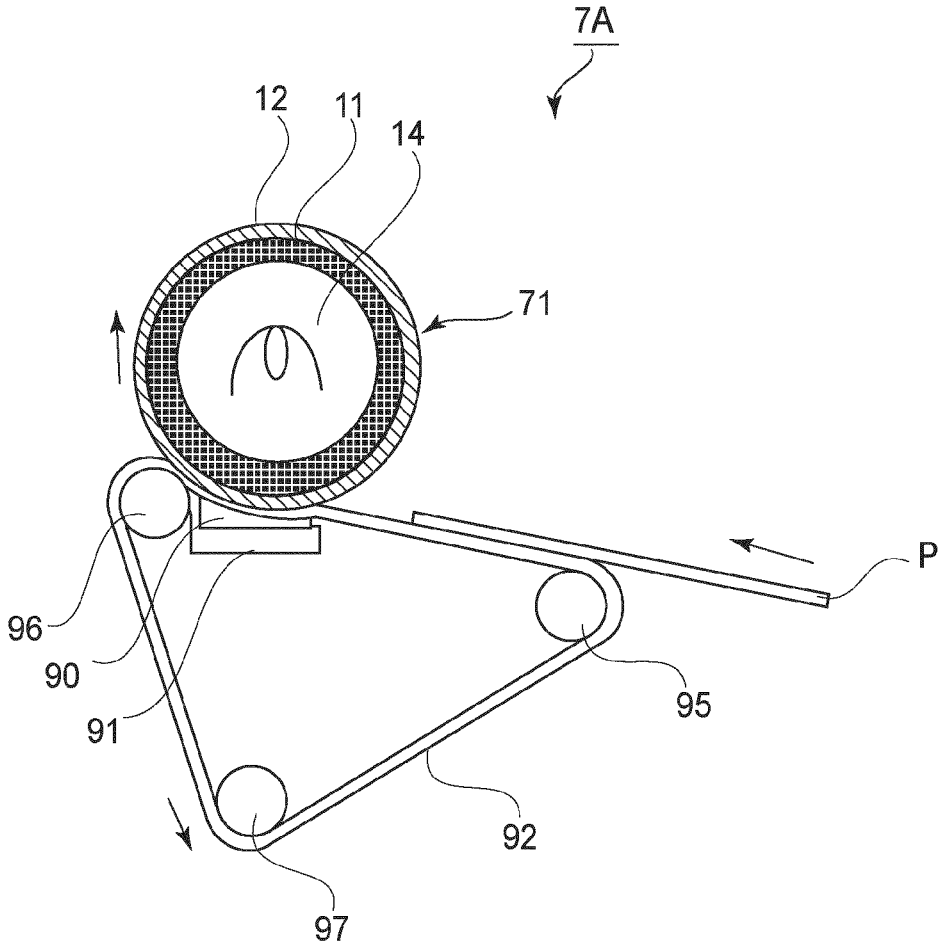
FIG. 6 is an illustration of an upstream fixing device.

FIG. 5 is an illustration of an image forming apparatus of a second embodiment, and FIG. 6 is an illustration of an upstream fixing device. The image forming apparatus 200 of the second embodiment is the same as that of the first embodiment except having replaced the fixing device 7 of FIG. 1 with two fixing devices 7A, 7B. In the description of this embodiment, the same reference numerals as in the foregoing Embodiment are assigned to the elements having the corresponding functions in this embodiment and the detailed description thereof is omitted for simplicity. In addition, in each table, the fixing device 7A means the upper fixing device (lower belt fixing device), and the fixing device 7A, 7B means the two fixing devices.

As shown in FIG. 5, the image forming apparatus 200 is provided with two fixing devices 7A, 7B which have the fixing nips maintained at the press-contact states. The downstream fixing device is retractable from the feeding path of the recording material P, and, by this, the fixing condition can be changed.

In the high glossiness setting, the controller 60 introduces the recording material P fixed by the fixing device 7A into the fixing device 7B, and the glossiness process for the recording material is carried out by the fixing nip NB. Thereafter, the recording material P is discharged by discharging rollers 88A.

In the low glossiness setting, the recording material P fixed by the fixing device 7A is not introduced to the fixing device 7B, and the controller 60 makes the recording material to bypass it. And, the recording material P is discharged from discharging rollers 88B.

The fixing nip NB is formed by press-contacting the pressing roller 74 to the fixing roller 73 in the downstream fixing device for the glossiness process 7B. The fixing roller 73 comprises a pipe-like core metal (steel) of the outer diameter 78 mm, and the 1-mm-thick silicone rubber elastic layer, and the surface thereof is coated with a parting layer tube of 30-micrometer-thick. A halogen heater is provided inside the fixing roller 73, and the output of the halogen heater is adjusted so that the surface temperature of the fixing roller 73 is 170 degrees C. (FIG. 3).

The pressing roller 74 comprises a cylindrical core metal (steel) of outer diameter 20 mm, and a sponge layer of the silicone rubber. The outer diameter thereof is 80 mm. The surface thereof is coated with a 30-micrometer-thick PFA tube parting layer. The pressing roller 74 is pressed by 700 Ns of total pressures to the fixing roller 73, and is rotated by the fixing roller 73

As shown in FIG. 6, in the upstream fixing device for the fixing process 7A, A circulatable endless belt 92 which is stretched around rollers 95, 96, and 97 is press-contacted to the rotatable fixing roller 71 so that a fixing nip (NA, FIG. 5) is formed. A pressing pad 90 supported by the pressing pad supporting portion 91 is provided in a contact position between the fixing roller 71 and the endless belt 92, and it presses the endless belt 92 against the fixing roller 71.

The fixing roller 71 comprises a core metal 11 (aluminum or steel tube) and an elastic layer 12, such as silicone rubber or fluorine-containing rubber. The endless belt 92 comprises a belt base material made by metal such as nickel, or resin materials, such as the polyimide, and a surface elasticity layers, such as silicone rubber or fluorine-containing rubber.

A heater, such as a halogen lamp, is provided inside the fixing roller 71, and to the surface of the fixing roller 71, an unshown thermistor is provided in contact (or non-contact) thereto (FIG. 3). An unshown temperature control circuit adjusts the temperature of the surface of the fixing roller 71 by controlling a voltage to the heater on the basis of the output of the thermistor.

The roller 96 is a separation roller made from a metal, and it is pressed so that it bites into the fixing roller 71 through the endless belt 92. By this, the elastic member of the fixing roller 71 is deformed and the recording material P is separated from the surface of the fixing roller 71.

In the image forming apparatus 200 of the second embodiment using the two kinds of fixing devices 7A, 7B, as shown in Table 5, the controller 60 sets the value (absolute value) of the transfer voltage in the secondary transfer of the toner image on the back side, in response to the combination of the fixing devices 7A, 7B used for the fixing of the front side image.

TABLE 5

Fixing conditions and secondary transfer voltage

| Paper g/m$^2$ | One-side | ups device (lower belt) L gloss | 2nd after both devices H gloss |
|---|---|---|---|
| A(105) | 3300 V | 3600 V | 3800 V |
| A(157) | 3900 V | 4200 V | 4400 V |
| B(250) | 4300 V | 4500 V | 4600 V |
| C(170) | 4000 V | 4200 V | 4500 V |
| D(105) | 3400 V | 3800 V | 4200 V |

By this, similarly to the first embodiment, the poor images which may be produced depending on the glossiness setting set by the user, such as the "coarse image" and the "white void", are prevented, and the optimal image is formed also on the back side.

The method of changing the combination of the fixing devices 7A, 7B to be used for the fixing is not limited to the usage of the alternate route (88A, 88B) shown in FIG. 5. The entirety of the fixing device 7A, 7B may be retracted from the feeding path of the recording material P as shown by an arrow D. By this, the combination which does not use the retracted fixing device (7A, 7B) may be established.

Third Embodiment

Figure 8:
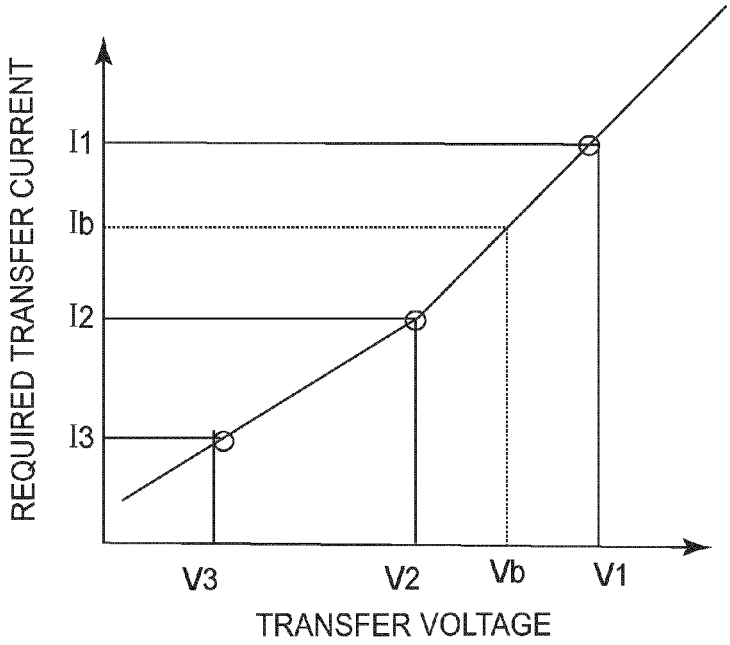
FIG. 8 is an illustration of a transfer voltage set correspondingly to a required transfer current.

FIG. 7 is an illustration of a transfer voltage setting including a resistance measurement of a transfer portion, and FIG. 8 is an illustration of a transfer voltage set correspondingly to a required transfer current. The third embodiment is related with a setting method of a usable transfer voltage in the image forming apparatus 200 of the second embodiment. Referring to FIG. 5, as to the structure of the image forming apparatus 200, the description will be omitted.

As shown in FIG. 5, the controller 60 controls the transfer power source D57 in the state without the recording material P, and measures the volt-ampere characteristic of the secondary transfer portion T2. The controller 60 sets the transfer voltage for the resupplied recording material P in response to the combination of the fixing devices having been used for the fixing and the measured volt-ampere characteristic. The transfer voltage is applied to the series circuit constituted by the external secondary transfer roller 57, the internal secondary transfer roller 56, and the recording material P, and therefore, An effective transfer voltage applied to the recording material fed through the secondary transfer portion T2 is the voltage provided by deducting a partial pressure of a volt-ampere characteristic (resistance) measured. For this reason, by measuring the volt-ampere characteristic of the secondary transfer portion before the transferring T2, the effective transfer voltage applied to the recording material can be controlled precisely.

When double-side printing mode is selected using the fixing devices 7A, 7B, The recording material P which has the toner image fixed by the fixing devices is switched back by an inverting pass 86 (or 87) in the image forming apparatus 200 to feed it to the feeding roller 85. The recording material P is again fed to the secondary transfer portion T2 from the registration roller 84 in the face-reversion state, and the toner image is transferred onto the back side of the recording material. At the time of the secondary transfer of the back side image, the controller 60 sets the value (absolute value) of the transfer voltage outputted from the transfer power source D57 in response to the combination of the fixing device 7A, 7B used for the fixing of the front side image.

The required transfer current Ib is stored in the controller 60 as the data for every kind of recording material P as shown in Table 6.

TABLE 6

(Paper A (157 g/m$^2$) Required transfer current Ib

| Paper g/m$^2$ | One-side | ups device (lower belt) L gloss | 2nd after both devices H gloss |
|---|---|---|---|
| L.H. (23° C. 5%) | 50 μA | 50 μA | 50 μA |
| Nor. (23° C. 50%) | 45 μA | 45 μA | 45 μA |

TABLE 6-continued

| (Paper A (157 g/m$^2$) Required transfer current Ib | | | |
|---|---|---|---|
| Paper g/m$^2$ | One-side | ups device (lower belt) L gloss | 2nd after both devices H gloss |
| H.H. (30° C. 80%) | 40 μA | 40 μA | 40 μA |

As shown in Table 7, in the controller 60, the voltage Vp of the recording material is stored as the data for the kind of recording material P (for every temperature and relative humidity).

TABLE 7

| (Paper A (157 g/m$^2$) Voltage across paper Vp | | | |
|---|---|---|---|
| Ambience | One-side | ups device (lower belt) L gloss | 2nd after both devices H gloss |
| L.H. (23° C. 5%) | 1400 V | 1700 V | 1900 V |
| Nor. (23° C. 50%) | 1100 V | 1200 V | 1400 V |
| H.H. (30° C. 80%) | 600 V | 700 V | 850 V |

When the user pushes the copy button, or sets the job on the terminal screen to start the printer operation, the image forming apparatus 200 rotates the intermediary transfer belt 51, without forming the toner image on the recording material for several seconds before the actual image forming operation, and carries out various settings. This rotation is called pre-rotation. For the external secondary transfer roller 57, the rotation after the user pushes the copy button or starts the printer operation until the recording material P and the toner image on the intermediary transfer belt 51 reach the secondary transfer portion T2 is the pre-rotation.

Referring to FIGS. 5 and 7, at the time of this pre-rotation, the controller 60 outputs the voltage with three-step switching from the transfer power source D57, and senses the current value relative to each voltage step using a current detecting circuit A57. In the third embodiment, the voltage is changed in the three steps and the voltage-current characteristic (so-called V-I property) is obtained. As shown in FIG. 8, a linear extraporation is carried out for the unmeasured points.

First, the first voltage V1 is applied over the external secondary transfer roller 57, the current values at that time are sensed, and the value provided by averaging them is I1. Similarly, The current value I2 corresponding to the second voltage V2 and the current values I3 corresponding to the third voltage V3 are determined in the third embodiment, V3<V2<V1.

The controller 60 processes the reference voltage Vb required in order to supply the required transfer current Ib to the external secondary transfer roller 57 on the basis of the measured V-I property and the data (Table 6) of the required transfer current Ib.

For example, the required transfer current at the time of transferring the toner image onto a certain recording material Ib is determined as follows by proportional processing with the V-I property from the relation between Ib and I2 of FIG. 8.

$$Ib<I2:\ Vb=(V2-V1)(Ib-I1)/(I2-I1)+V1$$

$$Ib\geqq I2:\ Vb=(V3-V2)(Ib-I2)/(I3-I2)+V2$$

The controller 60 adds the voltage Vp (Table 7) corresponding to the recording material to the reference voltage Vb, and calculates the transfer voltage Vtr to be applied to the external secondary roller 57 by the transfer voltage source D57.

$$Vtr=Vb+Vp$$

In the third embodiment, the table such as Table 7 is provided as to the voltage Vp for the recording material in this manner, also in the case of the image forming apparatus 200 which the impedance of the system of the secondary transfer portion for the secondary transfer T2 changes depending on the total hour of use, temperature and relative humidity, and so on, the constant voltage setting of the always proper transfer voltage can be carried out.

In the third embodiment, the voltage Vb determined from the impedance (resistance in the absence of paper) of the secondary transfer portion T2 for the secondary transfer and the voltage for the recording material Vp are stored as respective data. By this, even if the environmental variation and long use variation of the impedance of the secondary transfer portion T2 occur, always suitable secondary transfer voltage can be set.

The Other Embodiment

The present invention can be applied to full color image formation device of a tandem system in which the yellow, magenta, cyan and black image forming stations along the recording material transportation belt for attracting and carrying the recording material. In a known image forming apparatus, the four color front side images are transferred sequentially, and the recording material is separated from the recording material transportation belt, and the image is fixed by the fixing device. Thereafter, the recording material is again carried on the recording material transportation belt in the face-reversion state, and the four color back side images are received sequentially.

Also in such an image forming apparatus, if the combination of the fixing devices for the fixing of the front side image is changeable, the transfer voltage at the time of transferring the toner image onto the back side can be set to the optimal level correspondingly to the combination.

The transfer voltage of the positive polarity is used in order to transfer the toner charged to the negative polarity in the first-third embodiments. However, in the case of using the transfer voltage of the negative polarity in order to transfer the toner charged to the positive polarity, the similar effects can be provided by making the polarity of the transfer voltage negative, as shown in the first-third embodiments.

As described above, the fixing device in the embodiments includes the fixing device for fixing the unfixed toner image on the recording material, the fixing device for carrying out the full fixing of the half-fixing toner image on the recording material and the finishing heating system for carrying out the glossiness enhancing process by heating and pressing the fixed toner image.

The purpose of the use of two or more steps of fixing operations is not limited to the glossiness enhancing it may ensure the fixing to the recording material having a large heat capacity, and fixing to the recording material which has a large moisture content. It may be effected for the other object. In any case, corresponding to the combination of the fixing devices (fixing nips) used for the fixing of the eye the first time, the transfer voltage in the second toner image reception of the same recording material can be set on the basis of the processing or the reference table.

Figure 9:
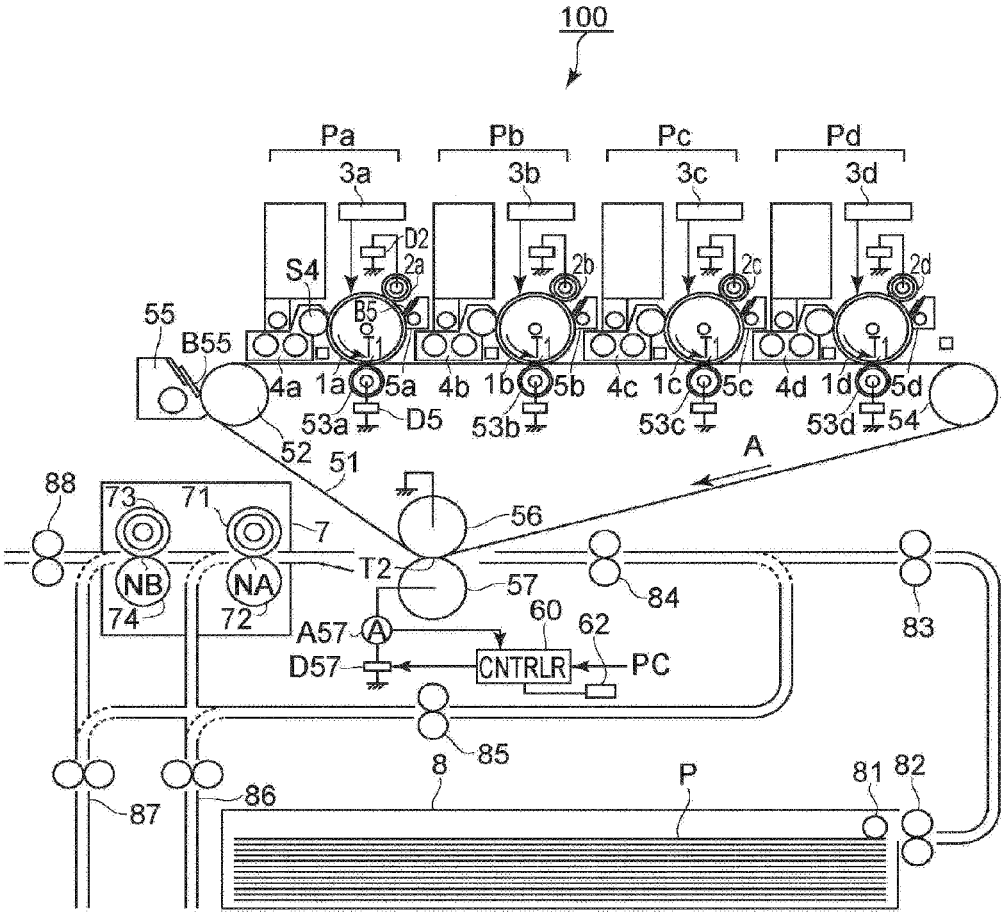
FIG. 9 is an illustration of an image forming apparatus of another embodiment.
Figure 10:
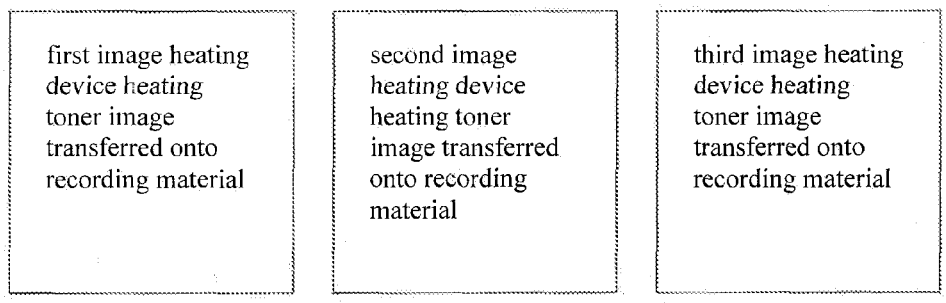
FIG. 10 is a schematic block diagram showing three image heating devices.

The glossiness of the toner image after the fixing is selected by the operation panel in the first-third embodiments. However, the selection of the glossiness is not limited to the usage of the operation panel. As shown in FIG. 9, the glossiness may be selected on the screen of a computer (PC) other than the image forming apparatus. In this case, the controller 60 selects the combination of the fixing nips NA, NB which should be used on the basis of the information with respect to the glossiness sent from PC. And, the controller (voltage adjusting means) 60 changes the set point (absolute value) of the transfer voltage at the time of the back side transferring in response to the moisture content of paper changed correspondingly to the combination of the fixing unit A, B at the time of the front surface fixing.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 028594/2007 filed Feb. 7, 2007, which is hereby incorporated by reference.

What is claimed is:

1. An image forming apparatus comprising:

an image bearing member configured to carry a toner image;

transferring means for forming a transfer portion for transferring a toner image from said image bearing member onto a recording material by being supplied with a transfer voltage;

a first image heating device configured to heat the toner image transferred onto the recording material;

a second image heating device configured to heat the toner image transferred onto the recording material;

a cassette for storing recording materials;

supplying means for supplying the recording material into said transfer portion from said cassette;

resupplying means for resupplying the recording material from one of said first and second image heating devices into said transfer means;

executing means for executing an operation in a first image forming mode for forming an image using said first image heating device without using said second image heating device, and an operation in a second image forming mode for forming an image by using said first image heating device and said second image heating device; and adjusting means for adjusting the transfer voltage in accordance with the kind of the recording material, wherein (i) when the kind of the recording material is plain paper and (i-i) when an image has already been formed on the plain paper in the first image forming mode and the plain paper has been resupplied using said resupplying means to said transfer portion, said adjusting means adjusts the transfer voltage to a first level, and (i-ii) when an image has already been formed on the plain paper in the second image forming mode and the plain paper has been resupplied using said resupplying means to said transfer portion, said adjusting means adjust the transfer voltage to a second level, and wherein (ii) when the kind of the recording material is coated paper and (ii-i) when an image has already been formed on the coated paper in the first image forming mode and resupplied using said resupplying means to said transfer portion, said adjusting means adjusts the transfer voltage to a third level, and (ii-ii) when an image has already been formed on the coated paper in the second image forming mode and resupplied using said resupplying means to said transfer portion, said adjusting means adjusts the transfer voltage to a fourth level, and wherein the first level F1, the second level F2, the third level F3, and the fourth level F4 of the transfer voltages satisfies $|(F2-F1)|<|(F4-F3)|$.

2. An apparatus according to claim 1, further comprising an ambient condition sensor configured to detect an ambient condition, wherein said adjusting means changes the levels of the transfer voltage in accordance with a result of detection of said ambient condition sensor.

3. An image forming method comprising the steps of:

preparing an image bearing member configured to carry a toner image;

preparing transferring means for forming a transfer portion for transferring a toner image from said image bearing member onto a recording material by being supplied with a transfer voltage;

preparing a first image heating device configured to heat the toner image transferred onto the recording material;

preparing a second image heating device configured to heat the toner image transferred onto the recording material;

preparing a cassette for storing recording materials;

preparing supplying means for supplying the recording material into said transfer portion from said cassette;

preparing resupplying means for resupplying the recording material from one of said first and second image heating devices into said transfer portion;

preparing executing means for executing an operation in a first image forming mode for forming an image using said first image heating device without using said second image heating device, and an operation in a second image forming mode for forming an image using said first image heating device and said second image heating device; and preparing adjusting means for adjusting the transfer voltage in accordance with the kind of the recording material, wherein (i) when the kind of the recording material is plain paper and (i-i) when an image has already been formed on the plain paper in the first image forming mode and resupplied using said resupplying means to said transfer portion, said adjusting means adjusts the transfer voltage to a first level, and (i-ii) when an image has already been formed on the plain paper in the second image forming mode and resupplied using said resupplying means to said transfer portion, said adjusting means adjusts the transfer voltage to a second level, and wherein (ii) when the kind of the recording material is coated paper and (ii-i) when an image has already been formed on the coated paper in the first image forming mode and resupplied using said resupplying means to said transfer portion, said adjusting means adjusts the transfer voltage to a third level, and (ii-ii) when an image has already been formed on the coated paper in the second image forming mode and resupplied using said resupplying means to said transfer portion, said adjusting means adjusts the transfer voltage to a fourth level, and wherein the first level F1, the second level F2, the third level F3, and the fourth level F4 of the transfer voltages satisfies, $|(F2-F1)|<|(F4-F3)|$.

4. A method according to claim 3, wherein the levels of the transfer voltage are changed in accordance with a result of detection of an ambient condition.

* * * * *